US011644202B2

(12) United States Patent
Cho et al.

(10) Patent No.: US 11,644,202 B2
(45) Date of Patent: May 9, 2023

(54) AIR CONDITIONER AND VENTILATION APPARATUS FOR THE SAME

(71) Applicant: SAMSUNG ELECTRONICS CO., LTD., Suwon-si (KR)

(72) Inventors: Sungjune Cho, Suwon-si (KR); Seonuk Na, Suwon-si (KR); Hyungmo Koo, Suwon-si (KR); Youjae Kim, Suwon-si (KR); Joonhyoung Kim, Suwon-si (KR); Hyunah Kim, Suwon-si (KR); Jaehyoung Sim, Suwon-si (KR); Eomji Jang, Suwon-si (KR); Dongho Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 322 days.

(21) Appl. No.: 17/069,085

(22) Filed: Oct. 13, 2020

(65) Prior Publication Data

US 2021/0108813 A1 Apr. 15, 2021

(30) Foreign Application Priority Data

Oct. 11, 2019 (KR) ..... 10-2019-0126243

(51) Int. Cl.
*F24F 7/00* (2021.01)
*F24F 13/10* (2006.01)
*F24F 7/007* (2006.01)

(52) U.S. Cl.
CPC ..... *F24F 7/007* (2013.01); *F24F 13/10* (2013.01)

(58) Field of Classification Search
CPC ..... F24F 7/007; F24F 13/10; F24F 1/0035; F24F 1/0041; F24F 2221/36
See application file for complete search history.

(56) References Cited

U.S. PATENT DOCUMENTS

2005/0260946 A1* 11/2005 Kim ..... F24F 1/0071 454/329
2006/0144055 A1* 7/2006 Ahn ..... F24F 11/30 236/51
2011/0088422 A1 4/2011 Jeung

FOREIGN PATENT DOCUMENTS

| | | |
|---|---|---|
| CN | 107166516 | 9/2017 |
| JP | 6-300312 | 10/1994 |
| JP | 2002-5472 | 1/2002 |
| JP | 2002-81701 | 3/2002 |
| JP | 2003-130417 | 5/2003 |
| JP | 2004-77082 | 3/2004 |
| JP | 2006-78113 | 3/2006 |

(Continued)

OTHER PUBLICATIONS

English translation of JP 2005-024230 (Kim et al.), Jan. 27, 2005. (Year: 2005).*

(Continued)

*Primary Examiner* — Marc E Norman
(74) *Attorney, Agent, or Firm* — Staas & Halsey LLP

(57) ABSTRACT

An air conditioner includes a main body including a body fan, a heat exchanger, and a body housing. A ventilation hose connects the main body to outdoor air. A ventilation module is attached to an outer side of the body housing, and includes a ventilation fan. The ventilation module switches between an exhaust mode in which indoor air is exhausted to the outdoors through the ventilation hose and an air supply mode in which outdoor air is supplied to the main body through the ventilation hose.

20 Claims, 20 Drawing Sheets

(56) References Cited

FOREIGN PATENT DOCUMENTS

| | | |
|---|---|---|
| JP | 2007-64513 | 3/2007 |
| JP | 4226012 | 2/2009 |
| JP | 2010-190480 | 9/2010 |
| KR | 10-2005-0015694 | 2/2005 |
| KR | 10-2005-0018210 | 2/2005 |
| KR | 10-2006-0013963 | 2/2006 |
| KR | 10-0600070 | 7/2006 |
| KR | 10-2006-0125040 | 12/2006 |
| KR | 10-0741746 | 7/2007 |
| KR | 10-0816918 | 3/2008 |
| KR | 10-0840999 | 6/2008 |
| KR | 10-0951916 | 4/2010 |
| KR | 10-0977572 | 8/2010 |
| KR | 10-1322717 | 10/2013 |
| WO | WO 2016/153371 | 9/2016 |

OTHER PUBLICATIONS

International Search Report dated Jan. 29, 2021 from International Application No. PCT/KR2020/013724, 3 pages.
Extended European Search Report dated Aug. 5, 2022 for European Application No. 20875309.5.

* cited by examiner

AIR CONDITIONER AND VENTILATION APPARATUS FOR THE SAME

CROSS-REFERENCE TO RELATED APPLICATION

This application is based on and claims priority under 35 U.S.C. § 119 to Korean Patent Application No. 10-2019-0126243, filed on Oct. 11, 2019 in the Korean Intellectual Property Office, the disclosure of which is incorporated herein by reference.

BACKGROUND

1. Field

The disclosure relates to an air conditioner having a ventilation apparatus.

2. Description of the Related Art

An air conditioner is a device that includes a compressor, a condenser, an expansion valve, an evaporator, and a blowing fan, and adjusts the indoor temperature, humidity, and air flow using a refrigeration cycle. The air conditioner may include an indoor unit disposed indoors and an outdoor unit disposed outdoors.

The indoor unit of the air conditioner includes a heat exchanger formed to allow a refrigerant to have heat exchanged with air, a blowing fan causing air to move, and a motor to drive the blowing fan so that the indoors is cooled or heated.

In general, in order to prevent energy loss when operating the air conditioner, all ventilation apparatuses, including a window, are closed. Such an environment causes carbon dioxide concentration in the room to rise, which may affect the human body. Accordingly, a ventilation apparatus including a total heat exchanger, an intake pipe, an exhaust pipe, an intake fan, and an exhaust fan may be provided in the air conditioner.

However, such a ventilation apparatus requires two holes to be formed in the wall for the intake pipe and the exhaust pipe, and occupies a large space due to having the two fans and the total heat exchanger.

SUMMARY

Therefore, it is an object of the disclosure to provide a ventilation apparatus that may be installed by forming only one hole in the wall while minimizing the installation space, and an air conditioner having the same.

It is another object of the disclosure to provide a ventilation apparatus easily coupled to and separated from a body of an air conditioner, and an air conditioner having the same, Additional aspects of the disclosure will be set forth in part in the description which follows and, in part, will be obvious from the description, or may be learned by practice of the disclosure.

According to an aspect of the disclosure, there is provided an air conditioner including: a main body including a body fan, a heat exchanger, and a body housing to accommodate the body fan and the heat exchanger; a ventilation hose connecting indoors to outdoors; and a ventilation module attached to an outer side of the body housing, the ventilation module having a ventilation fan and configured to switch between an exhaust mode in which air of the indoors is exhausted to the outdoors through the ventilation hose and an air supply mode in which air of the outdoors is supplied to the indoors through the ventilation hose.

The ventilation module may include a module housing configured to accommodate the ventilation fan, the module housing may include a module suction/discharge port to which the ventilation hose, a module suction port, and a module discharge port, the body housing may include a body suction port and a body discharge port, and the module discharge port may be located adjacent to the body suction port outside the body housing.

The module suction/discharge port may be located outside the body housing.

The ventilation module may include: a first damper provided to allow an inlet of the ventilation fan to communicate with one of the module suction port and the module suction/discharge port; and a second damper provided to allow an outlet of the ventilation fan to communicate with one of the module suction/discharge port and the module discharge port.

In the exhaust mode, the first damper may be provided to allow the inlet of the ventilation fan to communicate with the module suction port, and the second damper may be provided to allow the outlet of the ventilation fan to communicate with the module suction/discharge port.

In the air supply mode, the first damper may be provided to allow the inlet of the ventilation fan to communicate with the module suction/discharge port, and the second damper may be provided to allow the outlet of the ventilation fan to communicate with the module discharge port.

The ventilation module may include: a suction flow path configured to guide air suctioned through the module suction port to be directed to the inlet of the ventilation fan; a discharge flow path configured to guide air discharged through the outlet of the ventilation fan to be directed to the module discharge port; and a suction/discharge flow path configured to guide air suctioned through the module suction/discharge port to be directed to the inlet of the ventilation fan, or guide air discharged through the outlet of the ventilation fan to be directed to the module suction/discharge port.

The first damper may include: a cylindrical damper body having a bottom surface in a circular shape and a side surface extending from a rim of the bottom surface to be perpendicular to the bottom surface; and a rotation shaft portion formed at a center of the bottom surface to rotate the cylindrical damper body.

The cylindrical damper body may include: an inner space, a damper inlet formed on the side surface to allow air to be introduced into the inner space; and a damper outlet formed on a side opposite to the bottom surface to allow air to flow out of the inner space.

The second damper may include a shielding plate and a rotation shaft portion formed at one edge of the shielding plate to rotate the shielding plate.

The first damper may include a shielding plate and a rotation shaft portion formed at one edge of the shielding plate to rotate the shielding plate.

According to another aspect of the disclosure, there is provided an air conditioner including: a main body including a heat exchanger and a body fan; and a ventilation module coupled to the main body, wherein the ventilation module includes: a ventilation fan; a module housing configured to accommodate the ventilation fan, and including a module suction port to suction air of indoors, a module discharge port to discharge air to the indoors, and a module suction/discharge port to suction air of outdoors or discharge air to the outdoors; a first damper provided to allow an inlet of the ventilation fan to communicate with one of the module suction port and the module suction/discharge port; and a second damper provided to allow an outlet of the ventilation fan to communicate with one of the module suction/discharge port and the module discharge port.

The ventilation module may be configured to switch between an exhaust mode in which air of the indoors is exhausted to the outdoors and an air supply mode in which air of the outdoors is supplied to the indoors.

In the exhaust mode, the first damper may be provided to allow the inlet of the ventilation fan to communicate with the module suction port, and the second damper may be provided to allow the outlet of the ventilation fan to communicate with the module suction/discharge port.

In the air supply mode, the first damper may be provided to allow the inlet of the ventilation fan to communicate with the module suction/discharge port, and the second damper may be provided to allow the outlet of the ventilation fan to communicate with the module discharge port.

The first damper may include: a cylindrical damper body having a bottom surface in a circular shape and a side surface extending from a rim of the bottom surface to be perpendicular to the bottom surface; and a rotation shaft portion formed at a center of the bottom surface to rotate the cylindrical damper body.

The cylindrical damper body may include: an inner space, a damper inlet formed on the side surface to allow air to be introduced into the inner space; and a damper outlet formed on a side opposite to the bottom surface to allow air to flow out of the inner space.

The second damper may include a shielding plate and a rotation shaft portion formed at one edge of the shielding plate to rotate the shielding plate.

According to another aspect of the disclosure, there is provided a ventilation apparatus including: a ventilation hose connecting indoors to outdoors; and a ventilation module configured to switch between an exhaust mode in which air of the indoors is exhausted to the outdoors through the ventilation hose and an air supply mode in which air of the outdoors is supplied to the indoors through the ventilation hose, wherein the ventilation module includes: a housing having a suction port, a discharge port, and a suction/discharge port to which the ventilation hose is coupled; a ventilation fan disposed inside the housing; a first damper provided to allow an inlet of the ventilation fan to communicate with one of the suction port and the suction/discharge port; and a second damper provided to allow an outlet of the ventilation fan to communicate with one of the suction/discharge port and the discharge port.

The ventilation apparatus may be attached to an air conditioner having a body fan and a heat exchanger.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

Hereinafter, embodiments according to the disclosure will be described in detail with reference to the accompanying drawings.

Figure 1:
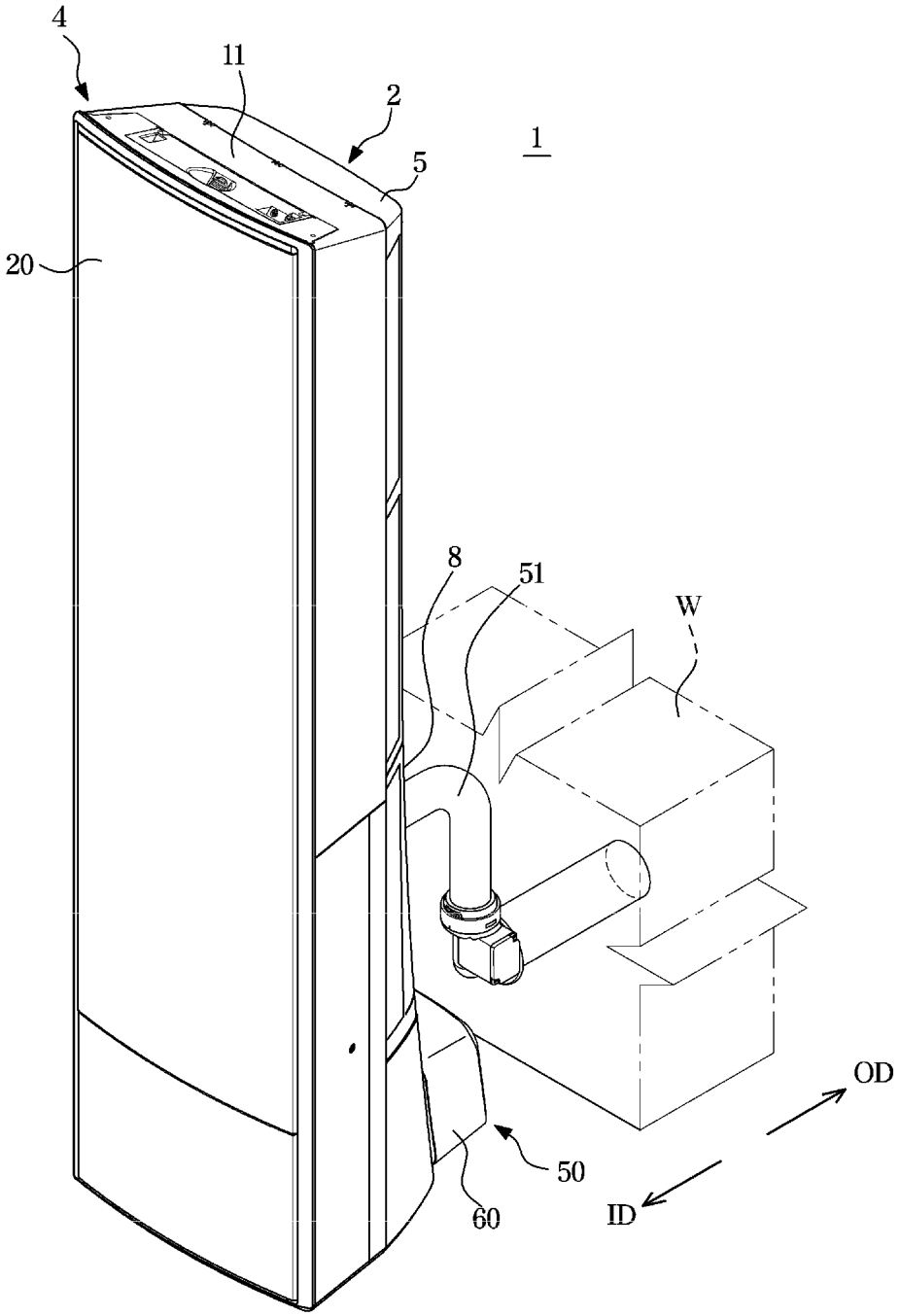
FIG. 1 is a perspective view illustrating an air conditioner according to an embodiment of the disclosure.
Figure 2:
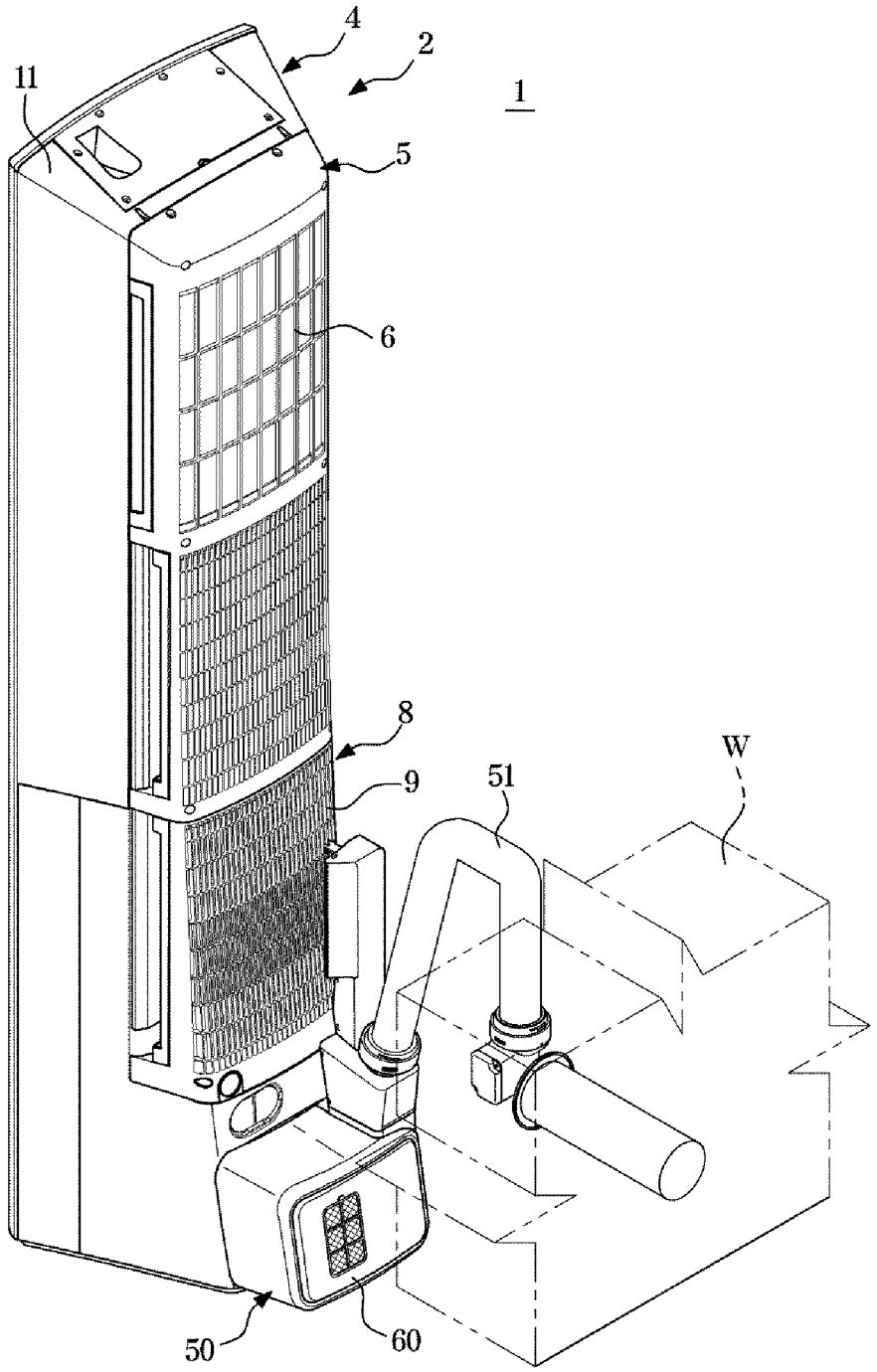
FIG. 2 is a rear perspective view illustrating an air conditioner according to an embodiment of the disclosure.
Figure 3:
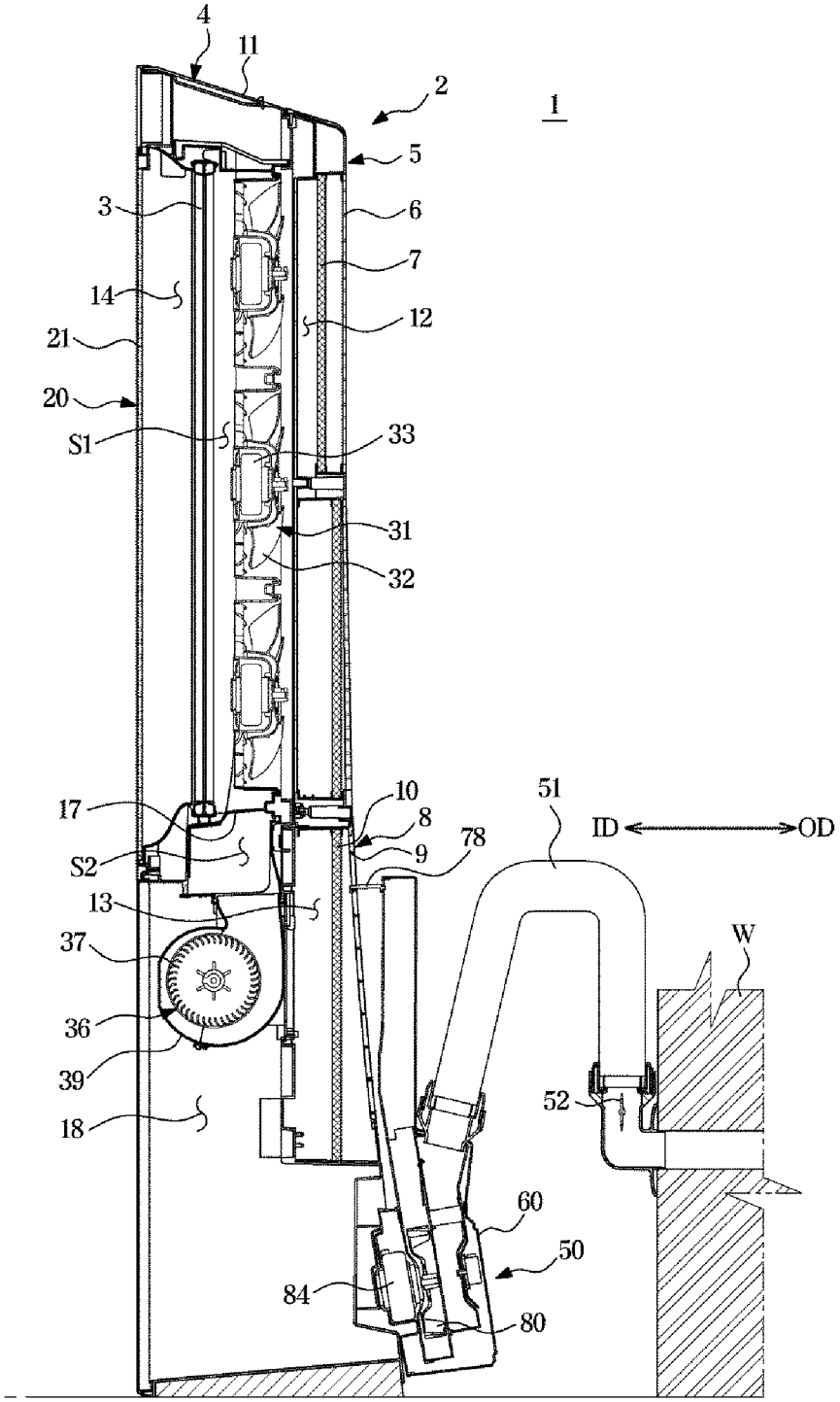
FIG. 3 is a side cross-sectional view illustrating an air conditioner according to an embodiment of the disclosure.
Figure 4:
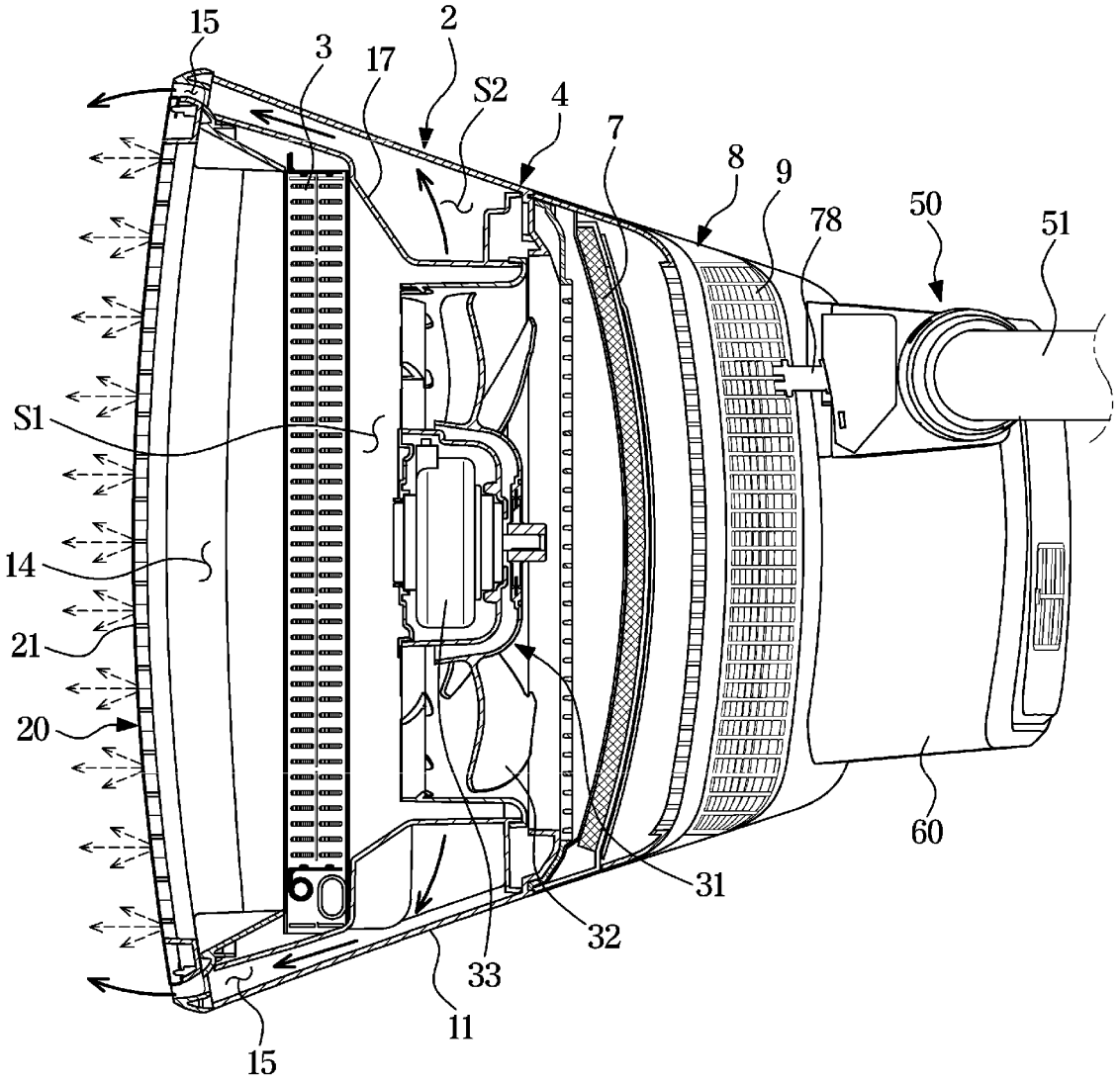
FIG. 4 is a plane view illustrating an air conditioner according to an embodiment of the disclosure.

FIG. 1 is a perspective view illustrating an air conditioner according to an embodiment of the disclosure, FIG. 2 is a rear perspective view illustrating an air conditioner according to an embodiment of the disclosure, FIG. 3 is a side cross-sectional view illustrating an air conditioner according to an embodiment of the disclosure, and FIG. 4 is a plane view illustrating an air conditioner according to an embodiment of the disclosure.

Referring to FIGS. 1 to 4, an air conditioner 1 according to the embodiment is described.

The air conditioner 1 includes a main body 2 and a ventilation apparatus 50. The main body 2 may be disposed indoors to suction indoor air, heat-exchange the indoor air and discharge the heat-exchanged indoor air into the indoors. However, unlike the embodiment, the main body 2 may be disposed outdoors to suction outdoor air, heat-exchange the outdoor air, and discharge the heat-exchanged outdoor air to the outdoors.

The ventilation apparatus 50 may ventilate indoor air and outdoor air. The ventilation apparatus 50 may be separably attached to the main body 2.

The main body 2 includes a housing 4, blowing units 31 and 36 provided inside the housing 4 to allow air to flow, and a heat exchange 3 to heat-exchange air introduced into the housing 4.

The housing 4 includes a case 11 in which the blowing units 31 and 36 and the heat exchanger 3 are mounted, a front panel 20 coupled to a front surface of the case 11, and filter frame 5 and 8 coupled to a rear surface of the case 11.

The case 11 may be formed with a first suction port 12 and a second suction port 13 at a rear side thereof. The first suction port 12 may be formed on an upper portion of a rear surface of the case 11. The second suction port 13 may be formed on a lower portion of the rear surface of the case 11. Indoor air may be sucked into the housing 4 through the first suction port 12 and the second suction port 13.

The case 11 may be formed with a first discharge port 14 at a front side thereof. The first discharge port 14 may be covered by the front panel 20. Air introduced into the housing 4 through the first suction port 12 may be heat-exchanged through the heat exchanger 3 and discharged to the front of the housing 4 through the first discharge port 14.

The first filter frame 5 may be installed on the first suction port 12 to prevent foreign substances from being sucked into the housing 4 through the first suction port 12. The first filter frame 5 may include a first grille 6 having a mesh shape and a first filter 7 provided to filter out foreign substances. The first filter 7 may include an electric dust collecting filter, a high efficiency particulate air filter (HEPA) filter, an antibacterial filter, a deodorizing filter, and the like.

The second filter frame 8 may be installed on the second suction port 13 to prevent foreign substances from being sucked into the housing 4 through the second suction port 13. The second filter frame 8 may be located below the first filter frame 5. The second filter frame 8 may include a second grille 9 having a mesh shape and a second filter 10 provided to filter out foreign substances. The second filter 10 may include an electric dust collecting filter, a high efficiency particulate air filter (HEPA) filter, an antibacterial filter, a deodorizing filter, and the like.

The case 11 is formed with a second discharge port 15 at a front side thereof. The second discharge ports 15 may be formed on the left and right sides of the first discharge port 14. Air introduced into the housing 4 through the second suction port 13 may be discharged to the front of the housing 4 through the second discharge port 15 without passing through the heat exchanger 3. The air discharged through the second discharge port 15 may be mixed with the air discharged from the first discharge port 14.

The main body 2 includes a first flow path S1 connecting the first suction port 12 to the first discharge port 14, and a second flow path S2 connecting the second suction port 13 to the second discharge port 15. The first flow path S1 and the second flow path S2 may be divided from each other. Accordingly, air flowing through the first flow path S1 and air flowing through the second flow path S2 may not be mixed with each other. A partition plate 17 may be provided inside the main body 2 to divide the first flow path S1 from the second flow path S2.

The heat exchanger 3 may be disposed in the first flow path S1. The second flow path S2 may not be provided with a heat exchanger.

An accommodation space 18 is formed inside the case 11, and various electronic parts required for driving the second blowing unit 36 and the air conditioner 1 may be disposed in the accommodation space 18.

The blowing units 31 and 36 may include a first blowing unit 31 and a second blowing unit 36. The first blowing unit 31 and the second blowing unit 36 may be driven independent of each other.

The first blowing unit 31 may be disposed on the first flow path S1. Air may be introduced into the housing 4 through the first suction port 12 by the first blowing unit 31. The air introduced through the first suction port 12 may move along the first flow path S1 to the heat exchanger 3 in which the air is heat exchanged and then discharged from the housing 4 through the first discharge port 14. The first blowing unit 31 may include a first blowing fan 32 and a first fan driving unit 33.

The first blowing fan 32 may be an axial fan or a mixed-flow fan that sucks air in the axial direction and discharges air in the axial direction. However, the type of the first blowing fan 32 is not limited thereto. The first fan driving unit 33 may drive the first blowing fan 32. The first fan driving unit 33 may be disposed in the center of the first blowing fan 32. The first fan driving unit 33 may include a motor.

The second blowing unit 36 may be disposed on the second flow path S2. Air may be introduced into the housing 4 through the second suction port 13 by the second blowing unit 36. Air introduced through the 13 may move along the second flow path S2 and be discharged from the housing 4 through the second discharge port 15.

The second blowing unit 36 may include a second blowing fan 37, a second fan driving unit, and a fan case 39.

The second blowing fan 37 may be a cross flow fan. However, the type of the second blowing fan 37 is not limited thereto. The second fan driving unit may drive the second blowing fan 37. The second fan driving unit may include a motor. The fan case 39 may cover the second blowing fan 37 and guide air.

The heat exchanger 3 may be disposed on the first flow path S1. The heat exchanger 3 may be disposed between the first blowing unit 31 and the first discharge port 14. The heat exchanger 3 may absorb heat from air introduced through the first suction port 12 or may transfer heat to air introduced through the first suction port 12. The heat exchanger 3 may include a header, a tube through which a refrigerant flows, and a heat exchange fin attached to the tube to expand a heat transfer area.

The front panel 20 may have a plurality of discharge holes 21 that are formed to pass through the front panel 20. Air guided to the first discharge port 14 may be caused to have a lower speed by passing through the plurality of discharge holes 21 and discharged to the outside of the housing 4.

The plurality of discharge holes 21 have a fine size and may be uniformly distributed over the entire area of the front panel 20. Wind discharged through the plurality of discharge holes 21 does not directly reach the user, and may gradually cool or heat the room.

The ventilation apparatus 50 may include a ventilation hose 51 provided to connect indoors ID to outdoors IO and a ventilation module 60 provided to switch between an exhaust mode in which air of the indoors is exhausted to the outdoors through the ventilation hose 51 and an air supply mode in which air of the outdoors is supplied to the indoors through the ventilation hose 51.

The ventilation hose 51 may be installed in a hole formed in a wall W that divides the indoors ID from and the outdoors IO. The ventilation hose 51 may be provided with an opening/closing damper 52 allowing air to flow between indoors and outdoors through the ventilation hose 51 or blocking the air.

The ventilation module 60 may be separably attached to the outside of the housing 4 of the main body 2. Specifically, the ventilation module 60 may be attached to a lower portion of the case 11 of the main body 2 or to the second filter frame 8.

Figure 6:
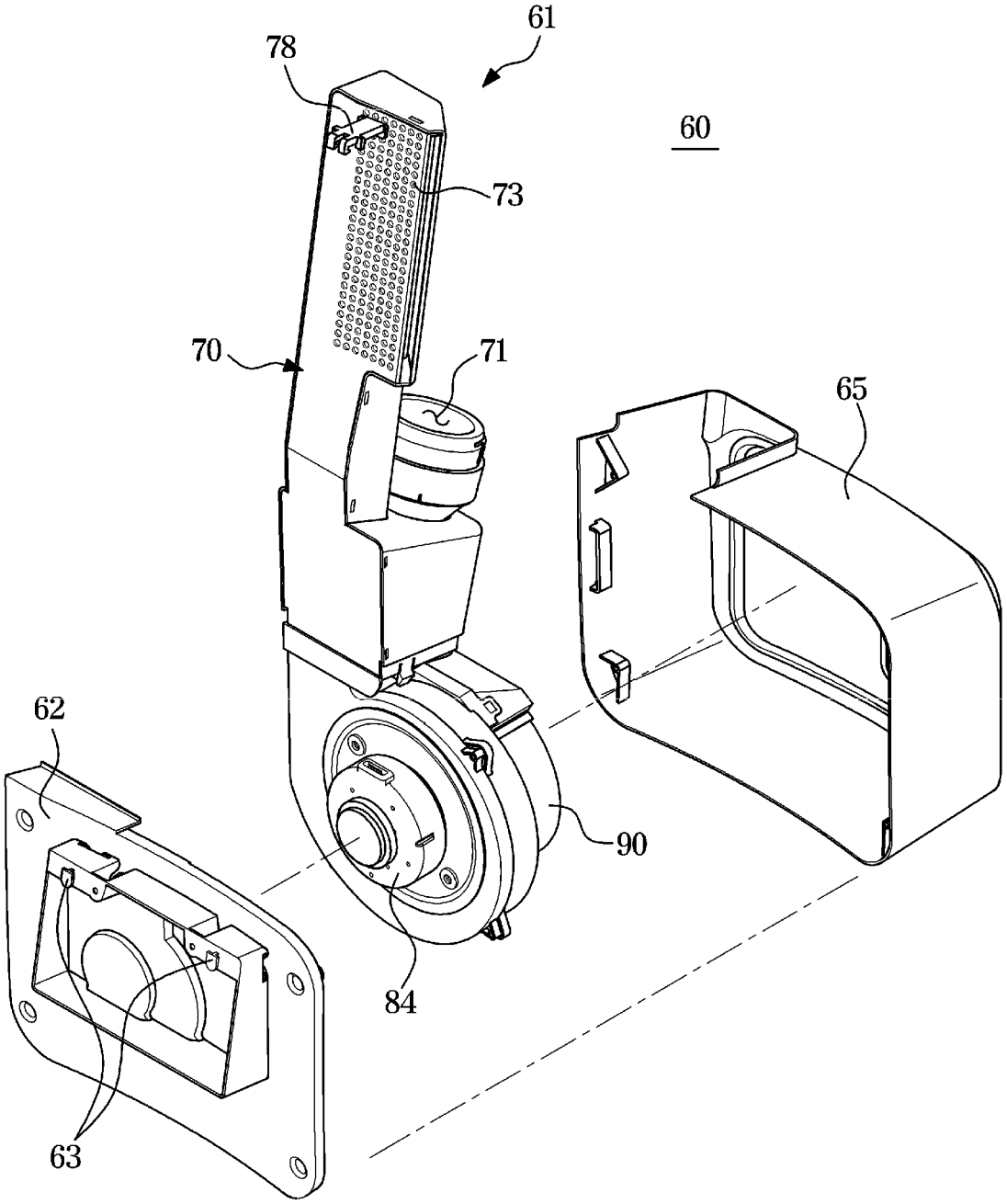
FIG. 6 is an exploded perspective view illustrating a ventilation module according to an embodiment of the disclosure.

The ventilation module 60 may include fixers 63 and 78 to be coupled to the outside of the housing 4 of the main body 2 (see FIG. 6). The fixers 63 and 78 may include a lower fixer 63 formed on a lower side of the ventilation module 60 and an upper fixer 78 formed on an upper side of the ventilation module 60.

The lower fixer 62 and the upper fixer 78 may be formed in the shape of a hook so as to be engaged with the outside of the housing 4 of the main body 2. The lower fixer 62 may be engaged with a fixer groove (not shown) formed in a lower portion of the case 11 of the main body 2 or in the second filter frame 8. The upper fixer 78 may be engaged with the grille 9 of the second filter frame 8.

As such, the ventilation module 60 may be easily installed on the outside of the housing 4 of the main body 2 by hanging the fixers 62 and 78 on the housing 4 of the main body 2, and conversely, the ventilation module 60 may be easily separated from the outside of the housing 4 of the main body 2 by slightly lifting the ventilation module 60.

However, unlike the embodiment, the ventilation module 60 may be coupled to the outside of the housing 4 of the main body 2 through a variety of known coupling methods, such as a fitting coupling or a coupling using separate fastening members (screws, pins, bolts, rivets, magnets, and adhesives).

As such, since the ventilation module 60 is installed on the outside of the housing 4 of the main body 2, there is no need to insert the ventilation hose 51 into the housing 4 of the main body 2, and the ventilation module 60 and the ventilation hose 51 may be easily connected to each other.

The ventilation module 60 may include a ventilation fan 80 and a ventilation motor 84 that drives the ventilation fan 80. That is, the ventilation module 60 according to the disclosure may perform air exhaust and supply using one ventilation hose 51 and one ventilation fan 80. The configuration of the ventilation module 60 according to the disclosure will be described below in detail.

Figure 5:
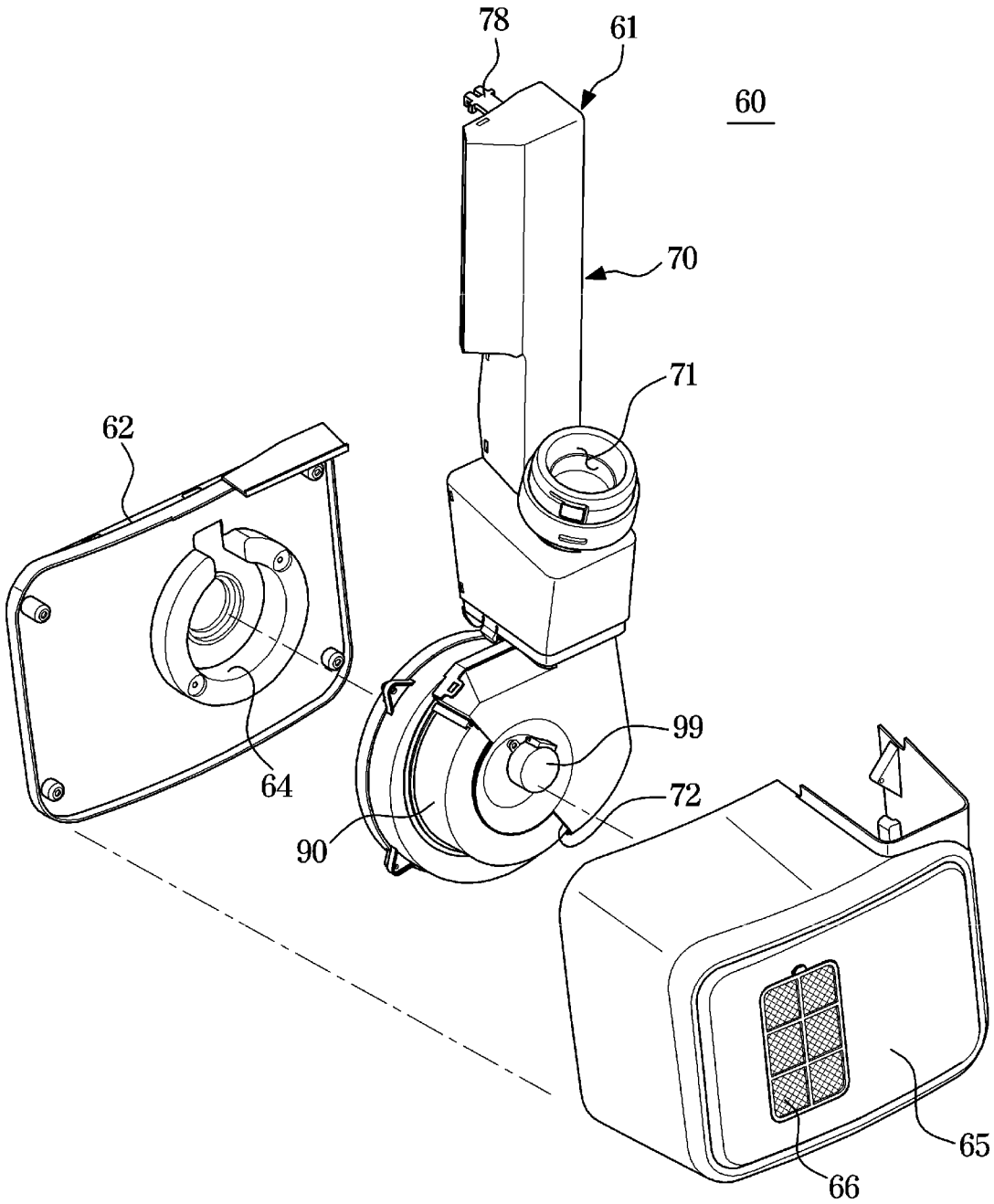
FIG. 5 is a rear exploded perspective view illustrating a ventilation module according to an embodiment of the disclosure.
Figure 7:
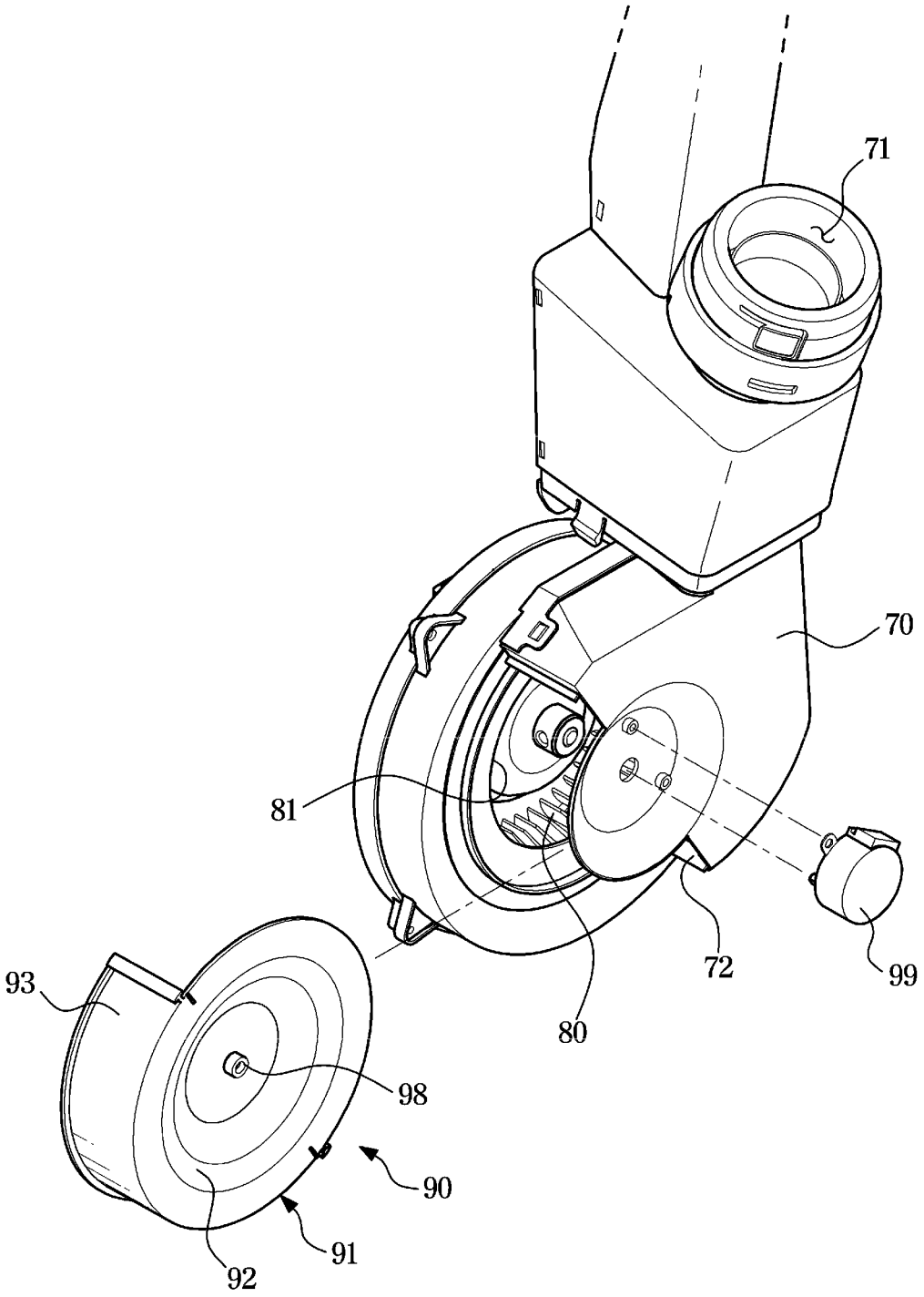
FIG. 7 is a view illustrating a ventilation module according to an embodiment of the disclosure in which a first damper is disassembled.
Figure 8:
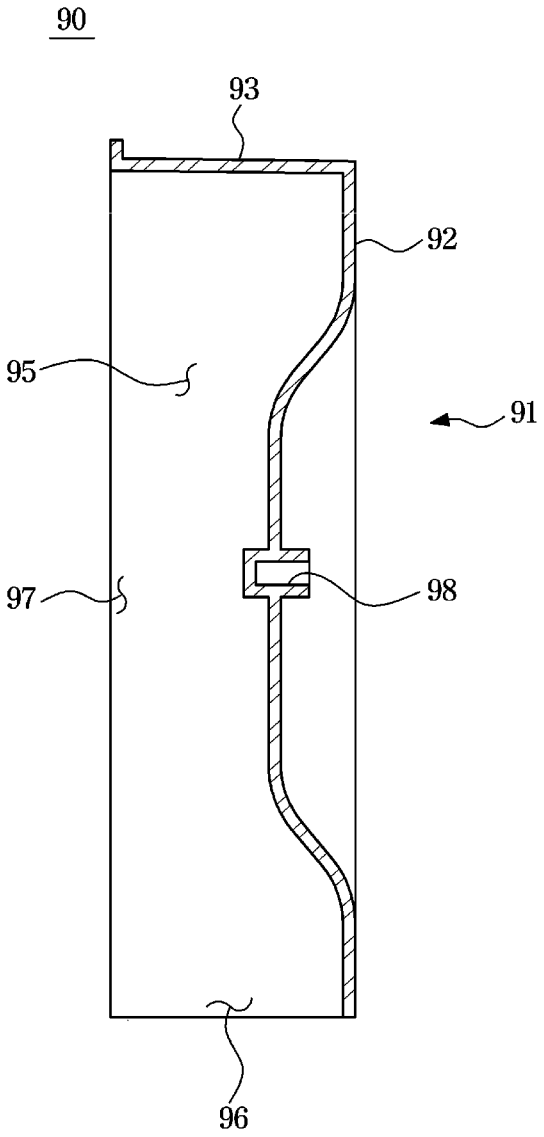
FIG. 8 is a cross-sectional view illustrating a first damper according to an embodiment of the disclosure.

FIG. 5 is a rear exploded perspective view illustrating a ventilation module according to an embodiment of the disclosure, FIG. 6 is an exploded perspective view illustrating a ventilation module according to an embodiment of the disclosure, FIG. 7 is a view illustrating a ventilation module according to an embodiment of the disclosure in which a first damper is disassembled, and FIG. 8 is a cross-sectional view illustrating a first damper according to an embodiment of the disclosure.

Referring to FIGS. 5 to 8, the ventilation module 60 may include the ventilation fan 80, a module housing 61, a first damper 90, and a second damper 100.

The ventilation fan 80 may be a centrifugal fan that sucks air in an axial direction 85 (FIG. 12) and discharges the air in the radial direction. The ventilation fan 80 may be driven by the ventilation motor 84.

The module housing 61 may include a main housing 70 and cover housings 62 and 65 coupled to the outside of the main housing 70. The cover housings 62 and 65 may include a first cover housing 62 and a second cover housing 65. The first cover housing 62 and the second cover housing 65 may be provided to surround a part of the main housing 70. The first cover housing 62 and the second cover housing 65 may be coupled to each other.

The first cover housing 62 may be coupled to the main body 2. The lower fixer 63 described above may be formed to protrude from one surface of the first cover housing 62 facing the main body 2. A motor mounting part 64 on which the ventilation motor 84 is mounted may be formed on the opposite surface of the first cover housing 62.

The second cover housing 65 may be provided with a module suction port 66. Air sucked through the module suction port 66 may be guided to the inside of the main housing 70 through an inlet 72 of the main housing 70. A filter may be installed at the module suction port 66 to prevent foreign substances from being sucked through the module suction port 66.

The main housing 70 may be provided with the ventilation fan 80 mounted therein. The main housing 70 includes a ventilation fan inlet 81 through which air is sucked into the ventilation fan 80, a ventilation fan outlet (82 in FIGS. 11 and 12) through which air is discharged from the ventilation fan 80, and a scroll portion 83 formed to guide the air discharged from the ventilation fan 80 to the ventilation fan outlet 82.

The main housing 70 includes the main housing inlet 72 through which air sucked through the module suction port 66 is sucked into the main housing 70, a module discharge port 73 through which air is discharged from the inside of the main housing 70 to the indoors, and a module suction/discharge port 71 to which the ventilation hose 51 is coupled and through which outdoor air flows into or out of the main housing 70. The upper fixer 78 described above may be formed to protrude from the main housing 70.

The module suction port 66, the module discharge port 73, and the module suction/discharge port 71 may all be located outside the housing 4 of the main body 2.

The module discharge port 73 may be disposed adjacent to the suction port 13 of the main body 2. Accordingly, the air discharged from the ventilation module 60 through the module discharge port 73 may be smoothly sucked into the interior of the main body 2 through the suction port 13 of the main body 2.

The ventilation module 60 may have an exhaust mode in which indoor air is exhausted to the outdoors through the ventilation hose 51 and an air supply mode in which outdoor air is supplied to the indoors through the ventilation hose 51, and may be provided to switch between the exhaust mode and the air supply mode.

To this end, the ventilation module 60 has a first damper 90 that allows the inlet 81 of the ventilation fan 80 to communicate with one of the module suction port 66 and the module suction/discharge port 71 without communicating with the other, and a second damper (100 in FIG. 12) that allows the outlet 82 of the ventilation fan 80 to communicate with one of the module suction/discharge port 71 and the module discharge port 73 without communicating with the other.

The first damper 90 may have a cylindrical damper body 91 and a rotation shaft portion 98 formed to rotate the damper body 91, and may be configured to be rotatable. The main housing 70 may be provided with a first damper motor 99 mounted thereon to drive the first damper 90.

The cylindrical damper body 91 may have a bottom surface 92 and a side surface 93 extending from a rim of the bottom surface 92 to be perpendicular to the bottom surface 92. The rotation shaft portion 98 may be formed at the center of the bottom surface 92.

The cylindrical damper body 91 may include an inner space 95, a damper inlet 96 formed by opening a part of the side surface 93 to allow air to flow into the inner space 95, and a damper outlet 97 formed by opening a surface opposite to the bottom surface 92 to allow air to flow out of the inner space 95.

Figure 12:
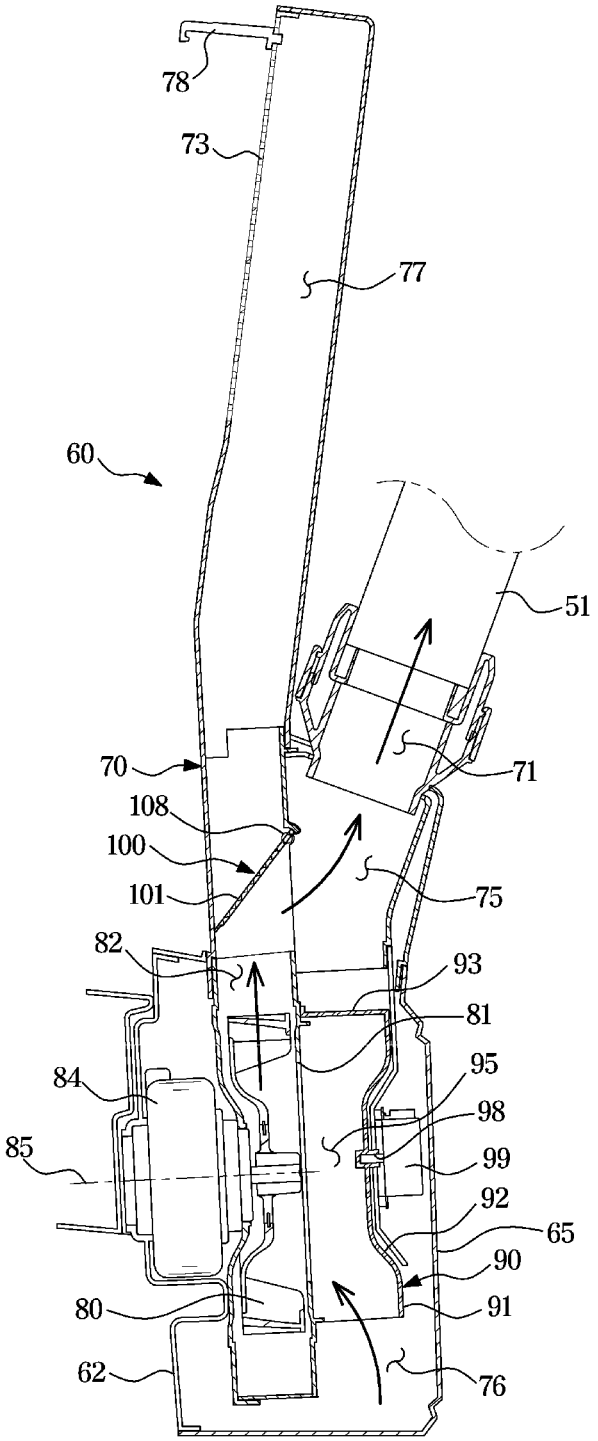
FIG. 12 is a cross-sectional view illustrating an exhaust mode of a ventilation module according to an embodiment of the disclosure.

The second damper 100 may have a shielding plate 101 and a rotation shaft portion 108 formed at one edge of the shielding plate 101 to rotate the shielding plate 101, and may be configured to be rotatable (see FIG. 12). The main housing 90 may be provided with a second damper motor 109 mounted thereon to drive the second damper 100.

Figure 9:
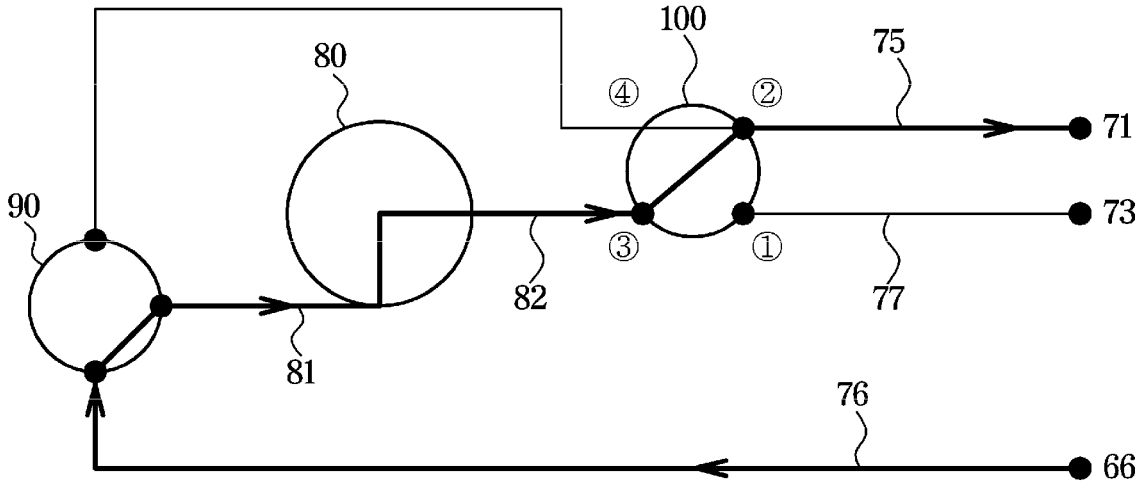
FIG. 9 is a view illustrating a flow of air in an exhaust mode of a ventilation module according to an embodiment of the disclosure.
Figure 10:
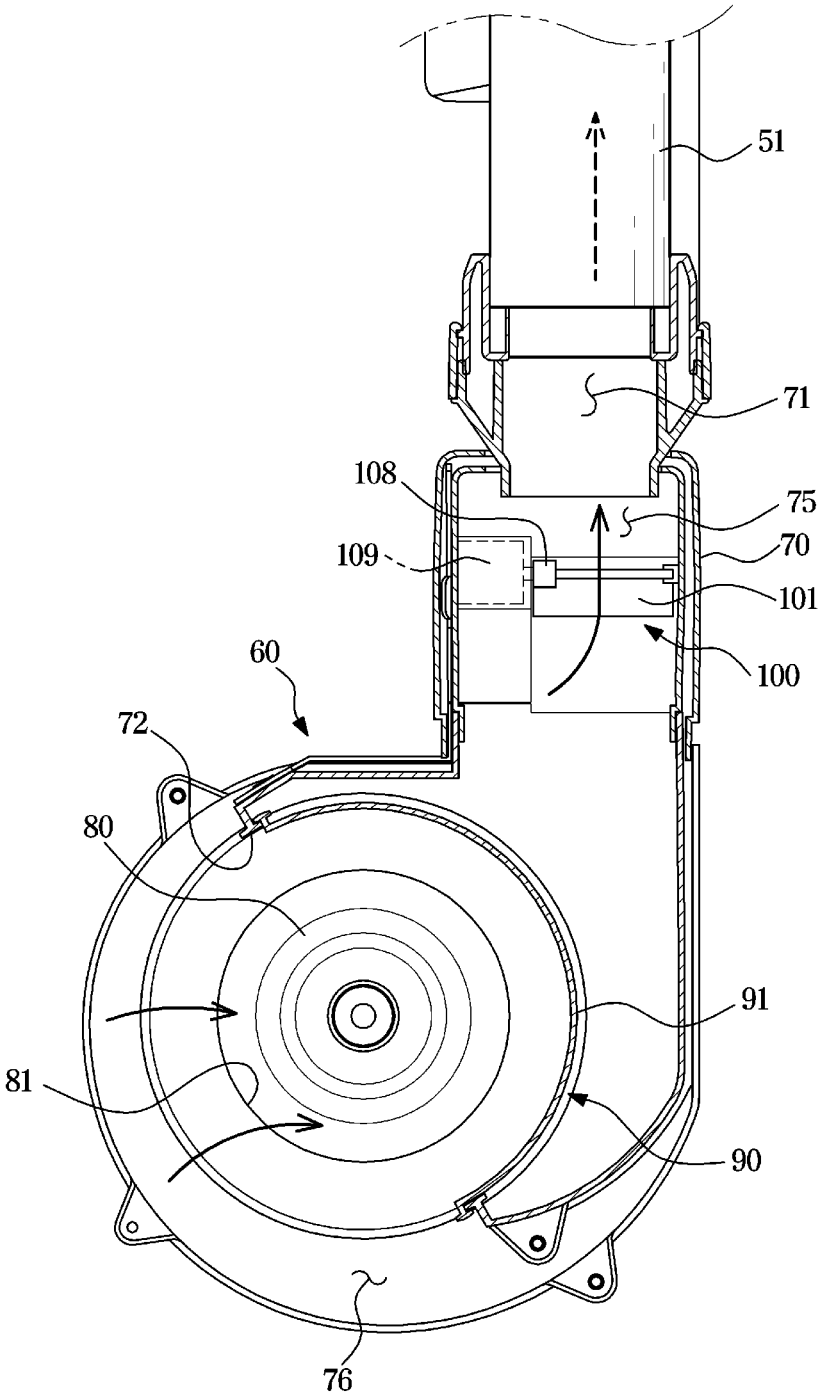
FIG. 10 is a cross-sectional view illustrating an exhaust mode of a ventilation module according to an embodiment of the disclosure.
Figure 11:
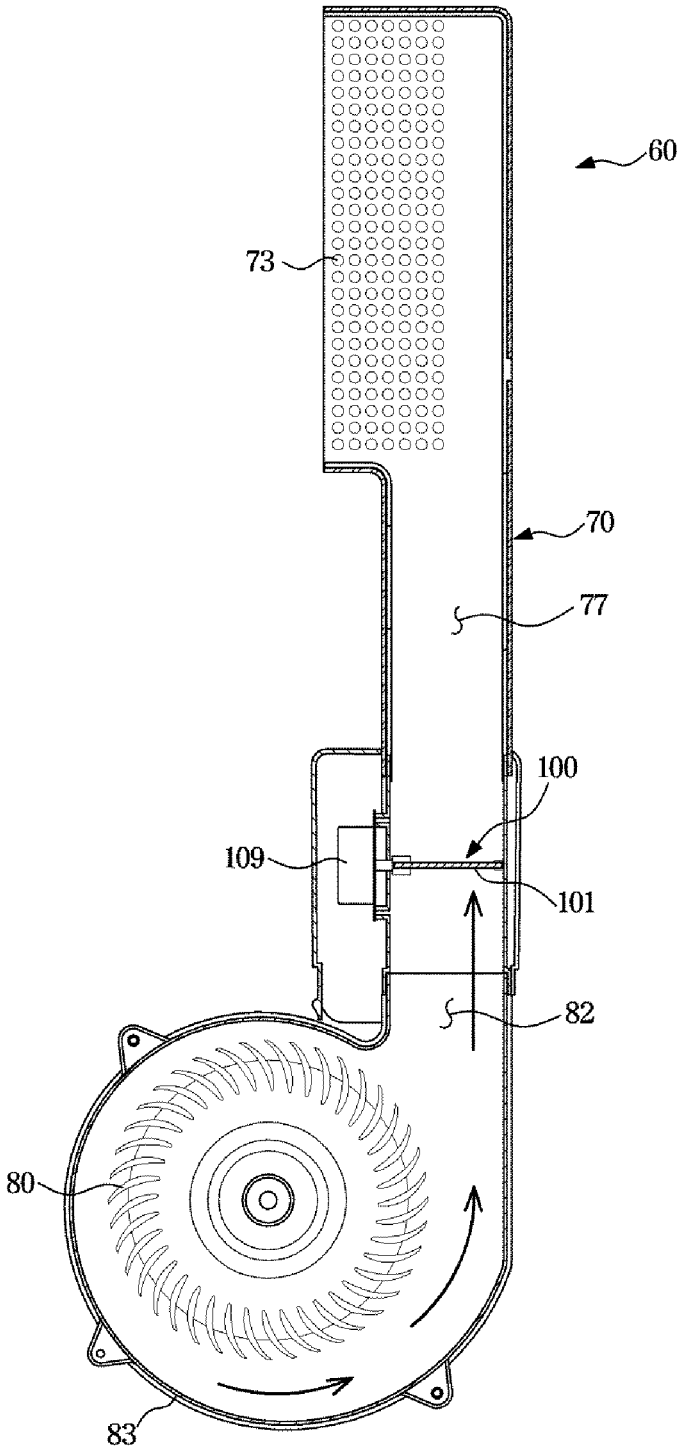
FIG. 11 is a cross-sectional view illustrating an exhaust mode of a ventilation module according to an embodiment of the disclosure.
Figure 13:
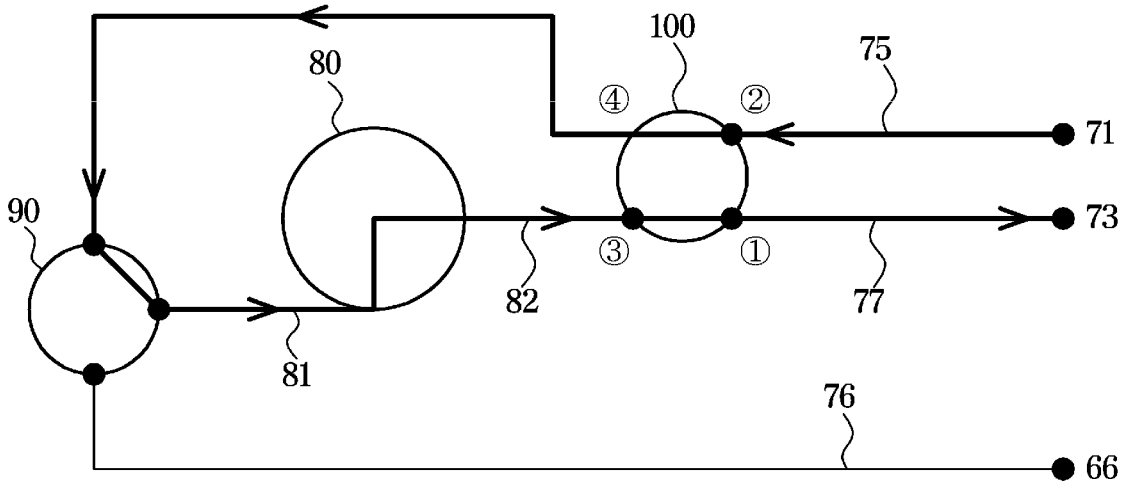
FIG. 13 is a view illustrating a flow of air in an air supply mode of a ventilation module according to an embodiment of the disclosure.
Figure 14:
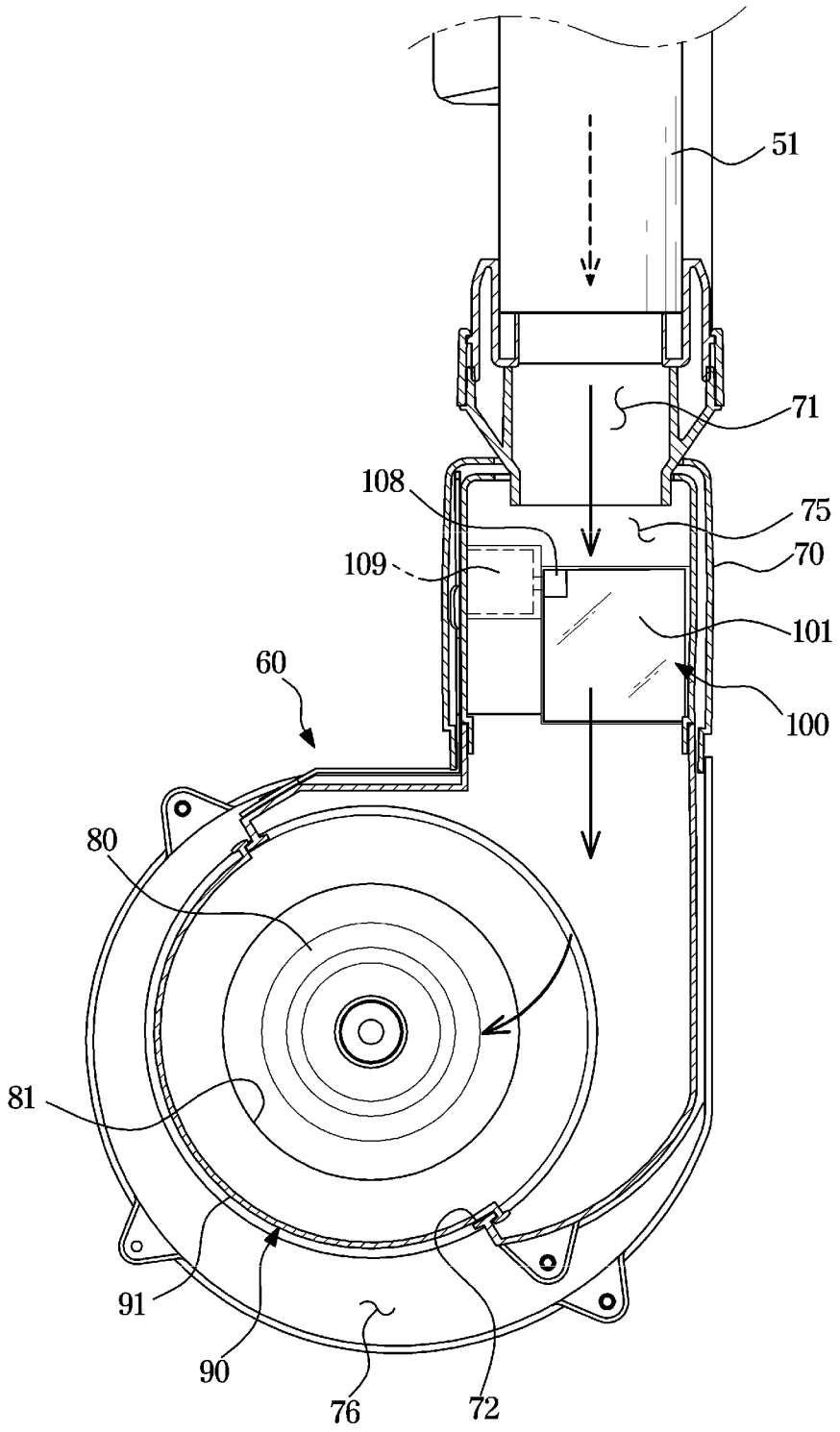
FIG. 14 is a cross-sectional view illustrating an air supply mode of a ventilation module according to an embodiment of the disclosure.
Figure 15:
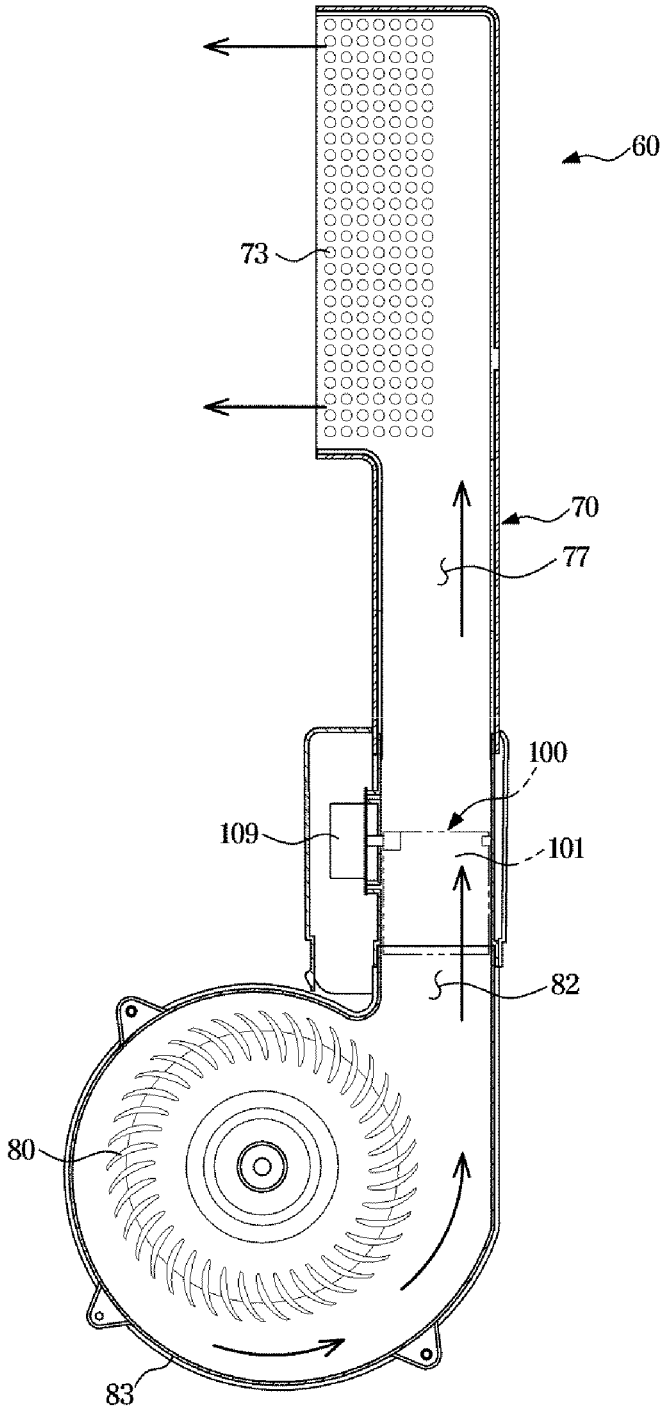
FIG. 15 is a cross-sectional view illustrating an air supply mode of a ventilation module according to an embodiment of the disclosure.
Figure 16:
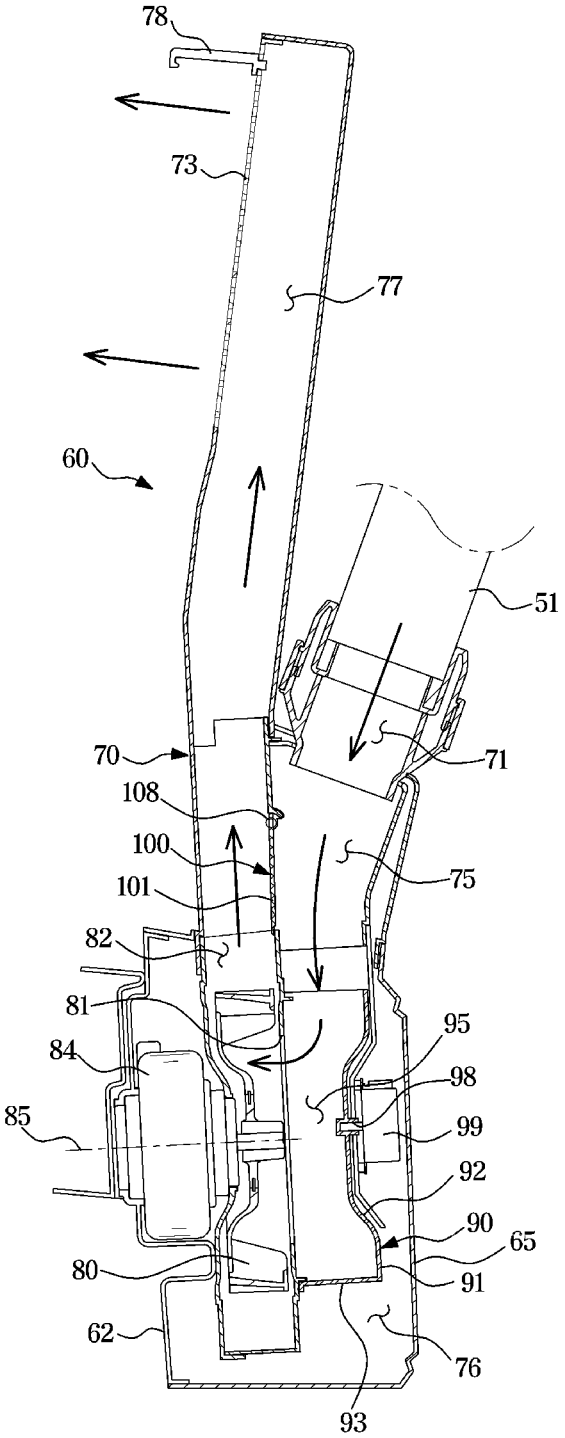
FIG. 16 is a cross-sectional view illustrating an air supply mode of a ventilation module according to an embodiment of the disclosure

FIG. 9 is a view illustrating a flow of air in an exhaust mode of a ventilation module according to an embodiment of the disclosure. FIG. 10 is a cross-sectional view illustrating an exhaust mode of a ventilation module according to an embodiment of the disclosure. FIG. 11 is a cross-sectional view illustrating an exhaust mode of a ventilation module according to an embodiment of the disclosure. FIG. 12 is a cross-sectional view illustrating an exhaust mode of a ventilation module according to an embodiment of the disclosure. FIG. 13 is a view illustrating a flow of air in an air supply mode of a ventilation module according to an embodiment of the disclosure. FIG. 14 is a cross-sectional view illustrating an air supply mode of a ventilation module according to an embodiment of the disclosure. FIG. 15 is a cross-sectional view illustrating an air supply mode of a ventilation module according to an embodiment of the disclosure. FIG. 16 is a cross-sectional view illustrating an air supply mode of a ventilation module according to an embodiment of the disclosure.

Hereinafter, the exhaust mode (FIGS. 9 to 12) and the air supply mode (FIGS. 13 to 16) of the ventilation module 60 according to the disclosure will be described.

The ventilation module 60 may include a suction flow path 76 that guides air sucked through the module suction port 66 to be directed to the inlet 81 of the ventilation fan 80, a discharge flow path 77 that guides air discharged from the ventilation fan 80 to be directed to the module discharge port 73, and a suction/discharge flow path 75 that guides air sucked through the module suction/discharge port 71 to be directed to the inlet 81 of the ventilation fan 80 or guide air discharged from the ventilation fan 80 through the outlet 82 of the fan 80 to be directed to the module suction/discharge port 71.

In the exhaust mode (FIGS. 9 to 12), the first damper 90 rotates such that the inlet 81 of the ventilation fan 80 communicates with the module suction port 66, and the second damper 100 rotates such that the outlet 82 of the ventilation fan 80 communicates with the module suction/discharge port 71. In this case, the first damper 90 prevents the inlet 81 of the ventilation fan 80 from communicating with the module suction/discharge port 71, and the second damper 100 prevents the outlet 82 of the ventilation fan 80 from communicating with the module discharge port 73.

In the exhaust mode, when the ventilation fan 80 operates, air of indoors may sequentially pass through the module suction port 66, the suction flow path 76, the ventilation fan 80, the suction/discharge flow path 75, the module suction/discharge port 71, and the ventilation hose 51, after which the air may be discharged outdoors.

In the air supply mode (FIGS. 13 to 16), the first damper 90 allows the inlet 81 of the ventilation fan 80 to communicate with the module suction/discharge port 71, and the second damper 100 allows the outlet 82 of the ventilation fan 80 to communicate with the module discharge port 73. In this case, the first damper 90 prevents the inlet 81 of the ventilation fan 80 from communicating with the module suction port 66, and the second damper 100 prevents the outlet 82 of the ventilation fan 80 from communicating with the module suction/discharge port 71.

In the exhaust mode, when the ventilation fan 80 is operated, air of outdoors may sequentially pass through the ventilation hose 51, the module suction/discharge port 71, the suction/discharge flow path 75, the ventilation fan 80, the discharge flow path 77, and the module discharge port 73, after which the air may be supplied to the indoors.

The air discharged from the ventilation module 60 through the module discharge port 73 may flow into the interior of the main body 2 through the suction port 13 of the main body 2 by the suction force of the blowing fan 37 of the main body 2, after which the air may be purified by the filter 10 provided in the main body 2 and supplied to the indoors.

As described above, the ventilation module 60 may implement air supply and exhaust through one ventilation fan 80 and one ventilation hose 51, and switch of air supply and exhaust may be performed through a plurality of dampers. Because the dampers have a simple shape, forming and assembly may be facilitated, and reliability of operation may be ensured.

Figure 17:
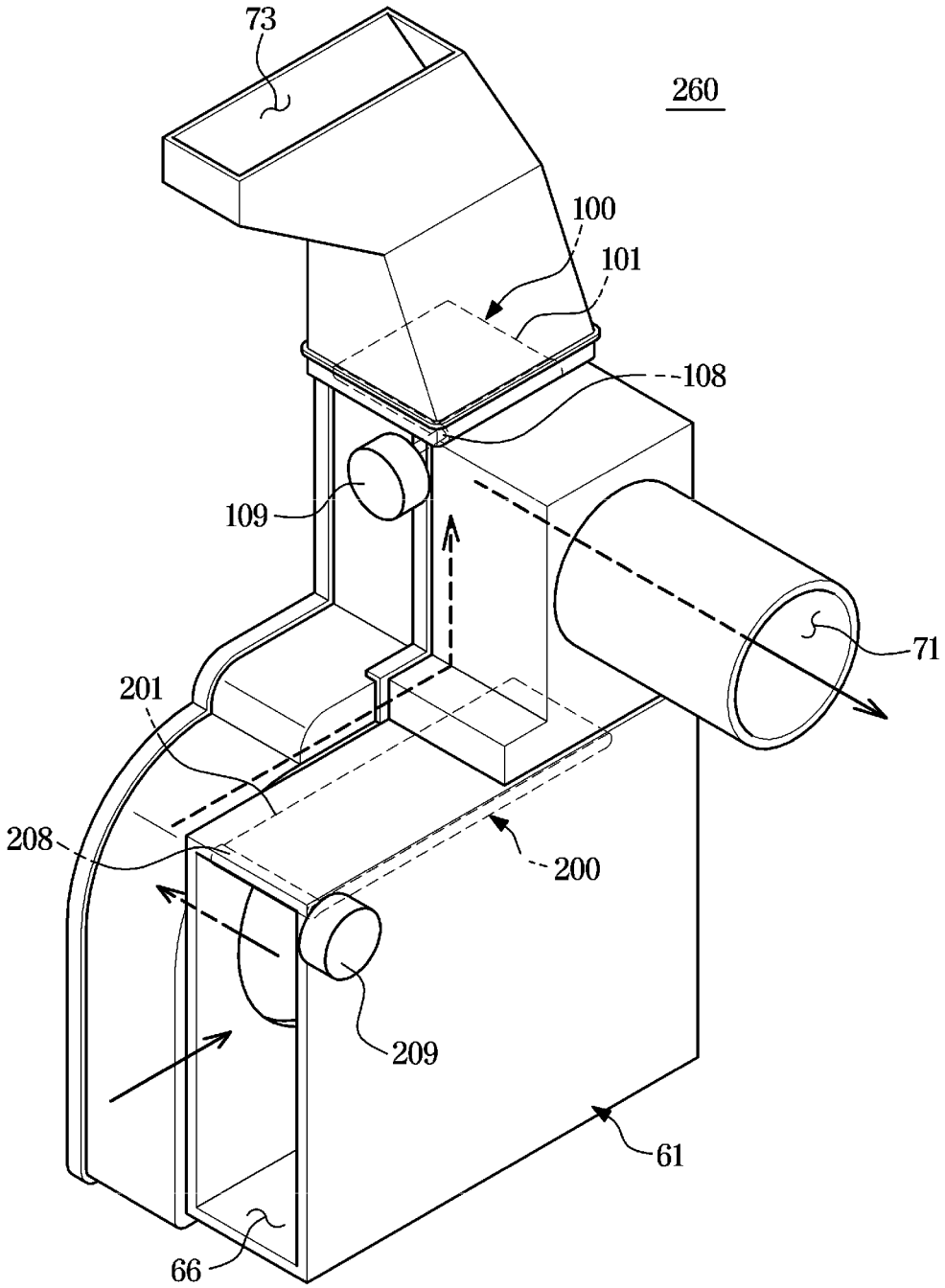
FIG. 17 is a view illustrating an exhaust mode of a ventilation module according to another embodiment of the disclosure.
Figure 18:
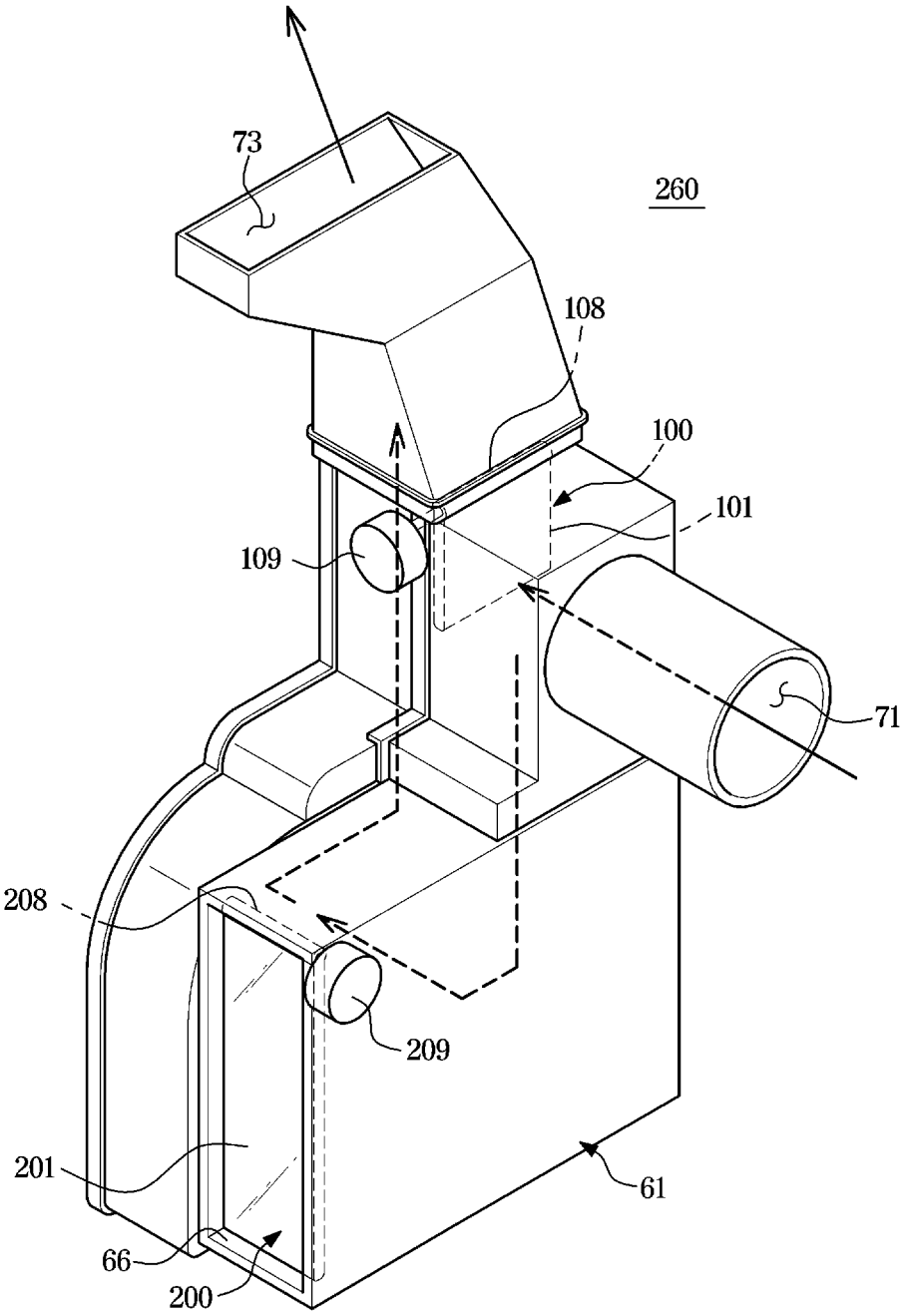
FIG. 18 is a view illustrating an air supply mode of a ventilation module according to another embodiment of the disclosure.

FIG. 17 is a view illustrating an exhaust mode of a ventilation module according to another embodiment of the disclosure. FIG. 18 is a view illustrating an air supply mode of a ventilation module according to another embodiment of the disclosure.

Referring to FIGS. 17 and 18, a ventilation module according to another embodiment of the disclosure will be described. The same reference numerals may be assigned to the same configurations as those of the above-described embodiment, and description thereof may be omitted.

In the above-described embodiment, a cylindrical damper is used as the first damper, and a flat damper is used as the second damper. However, the shape of the dampers is not limited thereto, and a flat damper may be used as the first damper, similar to the second damper.

A ventilation module 260 according to the embodiment may include a module housing 61, a ventilation fan, a first damper 200, and a second damper 100. The module housing 61 may be formed with a module suction port 66, a module discharge port 73, and a module suction/discharge port 71.

The first damper 200 may allow the inlet of the ventilation fan to communicate with one of the module suction port 66 and the module suction/discharge port 71 without communicating with the other. The second damper 100 may allow the outlet of the ventilation fan to communicate with one of the module suction/discharge port 71 and the module discharge port 73 without communicating with the other.

The first damper 200 may have a shielding plate 201 and a rotation shaft portion 208 formed at one edge of the shielding plate 201 to rotate the shielding plate 201, and may be configured to be rotatable. The module housing 61 may be provided with a first damper motor 209 mounted thereon to drive the first damper 200.

Figure 19:
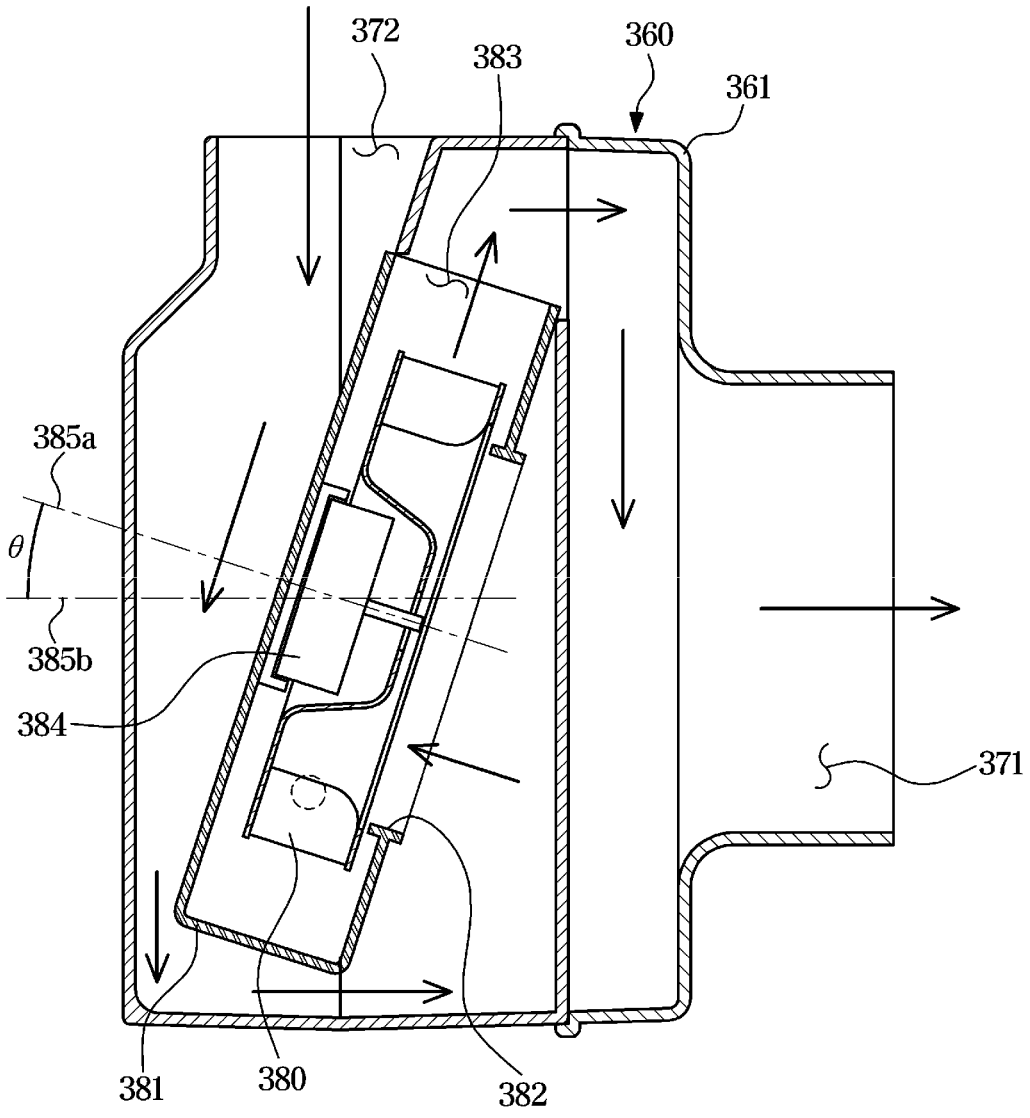
FIG. 19 is a view illustrating an exhaust mode of a ventilation module according to still another embodiment of the disclosure.
Figure 20:
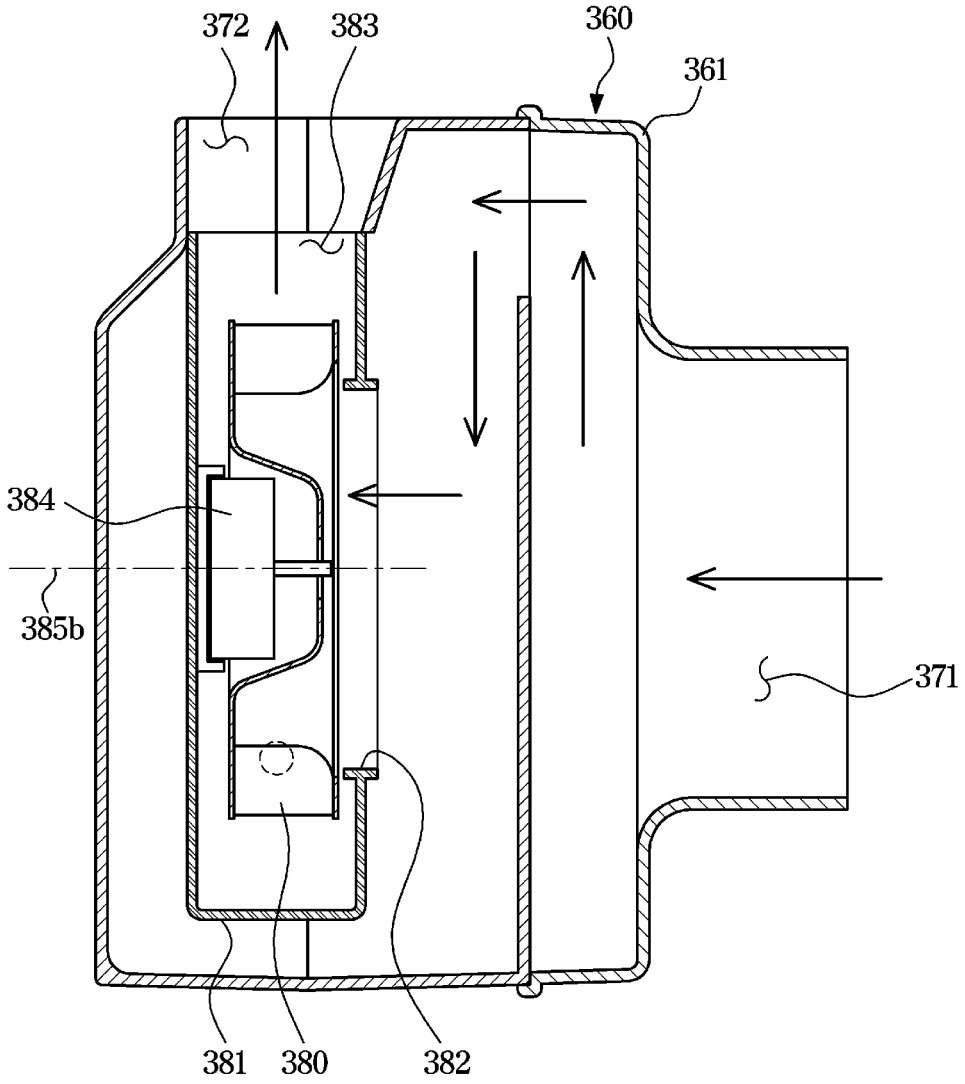
FIG. 20 is a view illustrating an air supply mode of a ventilation module according to still another embodiment of the disclosure.

FIG. 19 is a view illustrating an exhaust mode of a ventilation module according to still another embodiment of the disclosure. FIG. 20 is a view illustrating an air supply mode of a ventilation module according to still another embodiment of the disclosure.

Referring to FIGS. 19 to 20, a ventilation module according to another embodiment of the disclosure will be described. The same reference numerals may be assigned to the same configurations as those of the above-described embodiments, and description thereof may be omitted.

A ventilation module 360 according to the embodiment includes a module housing 361, a ventilation fan 380, a ventilation motor 384 to drive the ventilation fan 380, and a fan housing 381 on which the ventilation fan 380 and the ventilation motor 384 are mounted.

The module housing 361 may be formed with a first suction/discharge port 371 and a second suction/discharge port 372. A ventilation hose connecting indoors to outdoors may be coupled to the first suction/discharge port 371.

The fan housing 381 may be formed with an inlet 382 of the ventilation fan 380 and an outlet 383 of the ventilation fan 380. The fan housing 381 may be configured to be rotatable inside the module housing 361. As shown in FIGS. 19 and 20, the fan housing 381 may have a central axis 385*a* or 385*b* rotated at a predetermined angle θ.

In the exhaust mode (FIG. 19), the fan housing 381 may be rotated such that the second suction/discharge 372 communicates with the ventilation fan inlet 382 and the first suction/discharge port 371 communicates with the ventilation fan outlet 383. When the ventilation fan 380 is operated, air of indoors may be sucked into the ventilation module 360 through the second suction/discharge port 372, after which the air is discharged to the outdoors through the first suction/discharge port 371.

In the air supply mode (FIG. 20), the fan housing 381 may be rotated such that the first suction/discharge port 371 communicates with the ventilation fan inlet 382 and the second suction/discharge port 372 communicates with the ventilation fan outlet 383. When the ventilation fan 380 operates, air of outdoors may be sucked into the interior of the ventilation module 360 through the first suction/discharge port 371, after which the air may be supplied to the indoors through the second suction/discharge port 372.

As is apparent from the above, the air conditioner according to the aspect of the disclosure can be installed by forming only one hole in the wall, and facilitate coupling and separation between a ventilation apparatus and a body of the air condition.

The air conditioner according to the aspect of the disclosure can facilitate forming and assembly by simplifying the structure of a damper and a flow path for switching an exhaust mode and an air supply mode, and can improve the reliability of a product.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. An air conditioner comprising:
- a main body, configured to be located in an indoor environment, including
  - a body fan located in an interior of the main body, and
  - a heat exchanger located in the interior of the main body; and
- a ventilation module attached to an exterior of the main body, the ventilation module including:
  - a ventilation hose connecting the ventilation module to an outdoor environment and configured to allow air to flow between the indoor environment and the outdoor environment,
  - a ventilation fan, and
  - a module housing configured to accommodate the ventilation fan in an interior of the module housing,
- wherein the ventilation module is configured to switch between an exhaust mode in which air from the indoor environment is exhausted to the outdoor environment through the ventilation hose and an air supply mode in which air from the outdoor environment is supplied to the indoor environment through the ventilation hose,
- wherein the ventilation fan is provided at a lower portion of the module housing, and
- wherein the module housing includes an outlet of the ventilation fan provided at an upper side of the ventilation fan to discharge the air flow upward in the exhaust mode and the air supply mode.

2. The air conditioner of claim 1, wherein the module housing includes:
- a port to which the ventilation hose is coupled,
- a module suction port configured to suction air to the module housing, and
- a module discharge port configured to discharge air to the indoor environment, and
- wherein the main body includes:
  - a body suction port configured to suction air to the main body, and
  - a body discharge port configured to discharge air to the indoor environment, and
- wherein the module discharge port is located adjacent to the body suction port.

3. The air conditioner of claim 2, wherein the port is located at an exterior of the main body.

4. The air conditioner of claim 2, wherein the ventilation module includes
- a first damper configured to allow an inlet of the ventilation fan to communicate with one of the module suction port and the port, and
- a second damper configured to allow the outlet of the ventilation fan to communicate with one of the port and the module discharge port.

5. The air conditioner of claim 4, wherein, in the exhaust mode, the first damper is configured to allow the inlet of the ventilation fan to communicate with the module suction port, and the second damper is configured to allow the outlet of the ventilation fan to communicate with the port.

6. The air conditioner of claim 4, wherein, in the air supply mode, the first damper is configured to allow the inlet of the ventilation fan to communicate with the port, and the second damper is configured to allow the outlet of the ventilation fan to communicate with the module discharge port.

7. The air conditioner of claim 4, wherein the ventilation module includes, a suction flow path configured to guide air suctioned through the module suction port to the inlet of the ventilation fan, a discharge flow path configured to guide air discharged through the outlet of the ventilation fan to the module discharge port, and a suction/discharge flow path configured to guide air suctioned through the port to the inlet of the ventilation fan, or guide air discharged through the outlet of the ventilation fan to the port.

8. The air conditioner of claim 4, wherein the first damper includes, a cylindrical damper body having a bottom surface in a circular shape and a side surface extending from a rim of the bottom surface to be perpendicular to the bottom surface; and a rotation shaft portion formed at a center of the bottom surface to rotate the cylindrical damper body.

9. The air conditioner of claim 8, wherein the cylindrical damper body includes, an inner space, a damper inlet formed on the side surface to allow air to be introduced into the inner space, and a damper outlet formed on a side opposite to the bottom surface to allow air to flow out of the inner space.

10. The air conditioner of claim 4, wherein the second damper includes, a shielding plate and a rotation shaft portion formed at one edge of the shielding plate to rotate the shielding plate.

11. The air conditioner of claim 4, wherein the first damper includes a shielding plate and a rotation shaft portion formed at one edge of the shielding plate to rotate the shielding plate.

12. An air conditioner comprising:

a main body, configured to be installed in an indoor environment, including a heat exchanger, and a body fan; and a ventilation module, coupled to the main body, including:

a ventilation fan, a module housing configured to accommodate the ventilation fan in an interior of the module housing, the module housing including:

a module suction port to suction air from the indoor environment to the module housing, a module discharge port to discharge air to the indoor environment, and a port to suction air from an outdoor environment or discharge air to the outdoor environment, a first damper configured to allow an inlet of the ventilation fan to communicate with one of the module suction port and the port, and a second damper configured to allow an outlet of the ventilation fan to communicate with one of the port and the module discharge port, wherein the ventilation fan is provided at a lower portion of the module housing, and wherein the outlet of the ventilation fan is provided at an upper side of the ventilation fan to discharge the air flow upward in an exhaust mode and an air supply mode.

13. The air conditioner of claim 12, wherein the ventilation module is configured to switch between the exhaust mode in which air from the indoor environment is exhausted to the outdoor environment and the air supply mode in which air from the outdoor environment is supplied to the indoor environment.

14. The air conditioner of claim 13, wherein, in the exhaust mode, the first damper is configured to allow the inlet of the ventilation fan to communicate with the module suction port, and the second damper is configured to allow the outlet of the ventilation fan to communicate with the port.

15. The air conditioner of claim 13, wherein, in the air supply mode, the first damper is configured to allow the inlet of the ventilation fan to communicate with the port, and the second damper is configured to allow the outlet of the ventilation fan to communicate with the module discharge port.

16. The air conditioner of claim 12, wherein the first damper includes a cylindrical damper body having a bottom surface in a circular shape, and a side surface extending from a rim of the bottom surface to be perpendicular to the bottom surface, and a rotation shaft portion formed at a center of the bottom surface to rotate the cylindrical damper body.

17. The air conditioner of claim 16, wherein the cylindrical damper body includes, an inner space, a damper inlet formed on the side surface to allow air to be introduced into the inner space, and a damper outlet formed on a side opposite to the bottom surface to allow air to flow out of the inner space.

18. The air conditioner of claim 12, wherein the second damper includes a shielding plate and a rotation shaft portion formed at one edge of the shielding plate to rotate the shielding plate.

19. A ventilation apparatus comprising:

a ventilation hose connecting the ventilation apparatus to an outdoor environment; and a ventilation module including:

a housing having a suction port, a discharge port, and a port to which the ventilation hose is coupled, a ventilation fan disposed inside the housing, a first damper configured to allow an inlet of the ventilation fan to communicate with one of the suction port and the port; and a second damper configured to allow an outlet of the ventilation fan to communicate with one of the port and the discharge port, wherein the ventilation module is configured to switch between an exhaust mode in which indoor air is exhausted to the outdoor environment through the ventilation hose and an air supply mode in which outdoor air is supplied to the port through the ventilation hose, wherein the ventilation fan is provided at a lower portion of the housing, and wherein the housing has the outlet of the ventilation fan provided at an upper side of the ventilation fan to discharge the air flow upward in the exhaust mode and the air supply mode.

20. The ventilation apparatus of claim 19, wherein the ventilation apparatus is attached to an air conditioner having a body fan and a heat exchanger.

* * * * *